US008085238B2

(12) United States Patent
Misonou et al.

(10) Patent No.: US 8,085,238 B2
(45) Date of Patent: Dec. 27, 2011

(54) BACKLIGHT, DISPLAY APPARATUS AND LIGHT SOURCE CONTROLLING METHOD

(75) Inventors: Takehiro Misonou, Kanagawa (JP); Yuichi Ohyama, Kanagawa (JP)

(73) Assignee: Sony Corporation (JP)

( * ) Notice: Subject to any disclaimer, the term of this patent is extended or adjusted under 35 U.S.C. 154(b) by 832 days.

(21) Appl. No.: 11/581,667

(22) Filed: Oct. 16, 2006

(65) Prior Publication Data

US 2007/0120765 A1 May 31, 2007

(30) Foreign Application Priority Data

Oct. 18, 2005 (JP) ..... P2005-303405
Aug. 18, 2006 (JP) ..... P2006-223378

(51) Int. Cl.
*G09G 3/36* (2006.01)

(52) U.S. Cl. ..... 345/102; 345/87; 315/169.3

(58) Field of Classification Search ..... 345/102, 345/76–100; 315/169.3, 291
See application file for complete search history.

(56) References Cited

U.S. PATENT DOCUMENTS 6,069,676 A * 5/2000 Yuyama ..... 349/62
6,914,389 B2 * 7/2005 Chang et al. ..... 315/169.3
7,113,163 B2 * 9/2006 Nitta et al. ..... 345/102
7,202,850 B2 * 4/2007 Kitagawa ..... 345/102
7,277,079 B2 * 10/2007 Kobayashi et al. ..... 345/102
2003/0016205 A1 * 1/2003 Kawabata et al. ..... 345/102

FOREIGN PATENT DOCUMENTS

| | | |
|---|---|---|
| EP | 1 482 770 | 12/2004 |
| JP | 2000-275604 A | 10/2000 |
| JP | 2001-318614 A | 11/2001 |
| JP | 2002-072167 A | 3/2002 |
| JP | 2003-050569 A | 2/2003 |
| JP | 2004-275604 A | 10/2004 |
| JP | 2005-091526 A | 4/2005 |
| JP | 2005-157316 A | 6/2005 |
| JP | 2005-208486 A | 8/2005 |
| WO | 03/077013 | 9/2003 |

* cited by examiner

*Primary Examiner* — Alexander Eisen
*Assistant Examiner* — Viet Pham
(74) *Attorney, Agent, or Firm* — Lerner, David, Littenberg, Krumholz & Mentlik, LLP

(57) ABSTRACT

A backlight for illuminating the back of a display section includes a plurality of light sources disposed in positions corresponding to a display area of the display section; a diffusion member configured to transmit light from the light sources to the display section; a photo-sensor; a light guiding member configured to introduce the light from the light sources to the photo-sensor for detection; and an arithmetic operation processing section configured to calculate the luminance or chromaticity of each of the light sources from the luminance or chromaticity detected by the photo-sensor.

13 Claims, 9 Drawing Sheets

FIG.2A
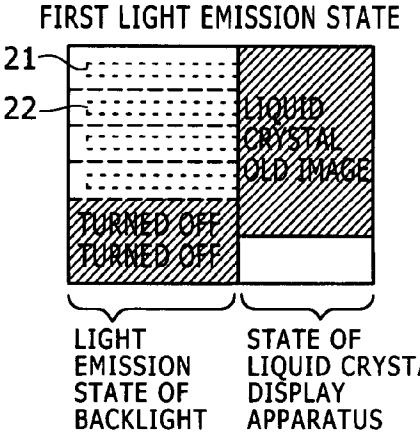
FIG.2B
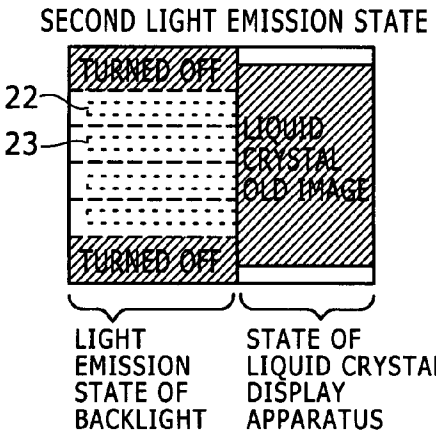
FIG.2C
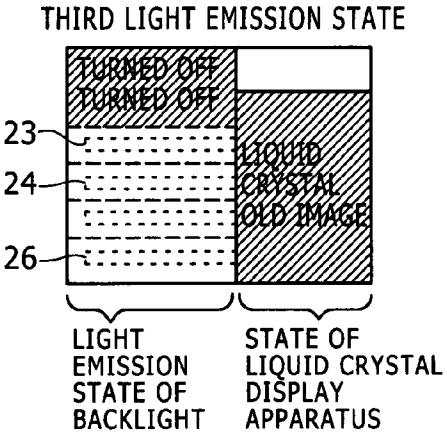
FIG.2D
FIG.2E
FIG.2F

FIRST LIGHT EMISSION STATE

SECOND LIGHT EMISSION STATE

THIRD LIGHT EMISSION STATE

FORUTH LIGHT EMISSION STATE

FIFTH LIGHT EMISSION STATE

SIXTH LIGHT EMISSION STATE

BACKLIGHT, DISPLAY APPARATUS AND LIGHT SOURCE CONTROLLING METHOD

CROSS-REFERENCE TO RELATED APPLICATIONS

The present application claims priority from Japanese Patent Application Nos. JP 2005-303405 filed on Oct. 18, 2005 and JP 2006-223378 filed on Aug. 18, 2006, the disclosures of which are hereby incorporated by reference herein.

BACKGROUND OF THE INVENTION

1. Field of the Invention

This invention relates to a backlight suitable for use typically with a liquid crystal display apparatus, a display apparatus which includes a backlight, and a light source controlling method for controlling lighting of a backlight.

2. Description of the Related Art

In a liquid crystal display apparatus, pixels themselves disposed on a display panel do not emit light. Therefore, a backlight is disposed on the back of the display panel such that the back of the display panel is illuminated by the backlight to display an image and so forth. Together with increase of the screen size of the liquid crystal display apparatus, the display area of the display panel tends to increase, and also the size of the backlight itself is increasing significantly.

FIGS. 8A and 8B show an example of a backlight disposed on the back of a display panel of a liquid crystal display apparatus in the past. More particularly, FIG. 8A shows the backlight as viewed from the front, and FIG. 8B shows the backlight as viewed from a side. Referring to FIGS. 8A and 8B, in the backlight shown, a cold cathode fluorescent lamp (CCFL) is used as a light emitting element. The backlight includes a light box 1, and a plurality of cold cathode fluorescent lamps 2 disposed in a vertical column in the light box 1 and extending horizontally. A reflection sheet 6 is disposed on the back side of the cold cathode fluorescent lamps 2. A diffusion plate 4 is disposed on the front of the light box 1 in which the cold cathode fluorescent lamps 2 are disposed. It is to be noted here that the side on which a display panel is disposed with respect to the backlight is referred to as front while the other side is referred to as back or rear. This similarly applies to the following description herein. Particularly, in FIG. 8B, the left side is the front side. The diffusion plate 4 is formed, for example, from an acrylic sheet or plate having a size substantially equal to the display area of the display panel and a predetermined thickness so that it may diffuse light. Further, a plurality of diffusion sheets 3 are disposed on the front of the diffusion plate 4. The diffusion sheets 3 may be formed from a thin film of a resin material having such a characteristic that, for example, it provides light with some directional property.

FIGS. 9A and 9B show another example of a configuration of a backlight where a partition plate is provided between adjacent ones of light sources. Particularly, FIG. 9A shows the backlight as viewed from the front while FIG. 9B shows the backlight as viewed from a side. Referring to FIGS. 9A and 9B, the backlight shown has a configuration same as that of the backlight of FIGS. 8A and 8B except the partition plate mentioned above. In particular, a partition plate 7 is disposed between adjacent ones of the plural cold cathode fluorescent lamps 2 disposed in the light box 1 so that light fluxes from the cold cathode fluorescent lamps 2 may be introduced to the diffusion plate 4 without being mixed with each other.

Where the configuration shown in FIGS. 9A and 9B is employed, blinking, that is, turning off, of some of the light sources can be performed in synchronism with a display image. In particular, where an image is displayed on a liquid crystal display apparatus in which a backlight is used, light emission control of the backlight called blinking is sometimes used in order to assure high moving picture responsibility. More particularly, the liquid crystal display panel temporarily enters a state in which the display state thereof is not fixed within a period within which a display signal is written into pixels disposed on the panel. This state is likely to be perceived by the user and deteriorates the picture quality of the display image, particularly the responsibility of moving pictures. Therefore, within a period within which a display signal is written into the pixels, the light source of the backlight on the back side of a pertaining horizontal light is turned off so that no light is emitted from the light source in order to enhance the responsibility of moving pictures. Where the partition plates 7 are provided as seen in FIGS. 9A and 9B, light fluxes from adjacent ones of the light sources, that is, the cold cathode fluorescent lamps 2, do not mix with each other. Therefore, a blinking process can be performed appropriately. A particular example of lighting control where a blinking process is involved is hereinafter described in connection with preferred embodiments of the present invention.

Japanese Patent Laid-open No. 2003-50569 discloses a liquid crystal image display apparatus wherein lighting (turning on/off) control of a backlight is performed in synchronism with re-writing of an image in order to assure high moving picture visibility.

Incidentally, where light fluxes from light sources are partitioned by partition plates as in the backlight of FIGS. 9A and 9B, if the luminances of the light sources are not uniform, then the display image suffers from unevenness in luminance, resulting in deterioration of the picture quality. In particular, if the light fluxes from the cold cathode fluorescent lamps 2 which form the light sources have some unevenness in luminance or chromaticity, then this gives rise to unevenness in brightness as viewed from the front face side and provides unevenness in brightness of the display image. This results in deterioration of the picture quality of the display image. Such unevenness in luminance or chromaticity of emitted light is caused by a dispersion in luminance which the light sources, in the example described, cold cathode fluorescent lamps, originally have. The unevenness in luminance or chromaticity is sometimes caused also by the degree of progress of deterioration by a secular change.

One of possible solutions to the problem just described is to attach a photo-sensor in the proximity of each of light sources disposed in a backlight such that the luminance of light from the light source is corrected individually in response to the luminance or chromaticity detected by the photo-sensor. However, if a number of photo-sensors equal to the number of light sources are provided, then a great number of photo-sensors are demanded for one backlight. This provides a problem that the backlight is complicated very much in configuration.

It is to be noted that, although the problems where the backlight is configured principally for blinking are described above, the problem of unevenness in luminance of light emitted from light sources is involved also in such a configuration that no partition plate is provided as shown in FIGS. 8A and 8B.

Therefore, it is demanded to provide a backlight, a display apparatus and a light source controlling method by which light emission control free from display unevenness can be performed simply.

SUMMARY OF THE INVENTION

According to an embodiment of the present invention, there is provided a backlight for illuminating the back of a display section, including a plurality of light sources, a diffusion member, a photo-sensor, a light guiding member, and an arithmetic operation processing section. The plurality of light sources are disposed in positions corresponding to a display area of the display section. The diffusion member is configured to transmit light from the light sources to the display section. The light guiding member is configured to introduce the light from the light sources to the photo-sensor for detection. The arithmetic operation processing section is configured to calculate the luminance or chromaticity of each of the light sources from the luminance or chromaticity detected by the photo-sensor.

With the backlight, the luminance or chromaticity of light emitted from the plural light sources can be detected using a limited number of photo-sensors. Consequently, the luminance or chromaticity of each of the prepared light sources can be detected with a simple configuration. Further, control to make the light emission states of the light sources more uniform can be implemented with a simple configuration.

BRIEF DESCRIPTION OF THE DRAWINGS

FIGS. 2A to 2F are schematic views illustrating scanning blinking of a backlight of the liquid crystal display apparatus;

DETAILED DESCRIPTION

Figure 1:
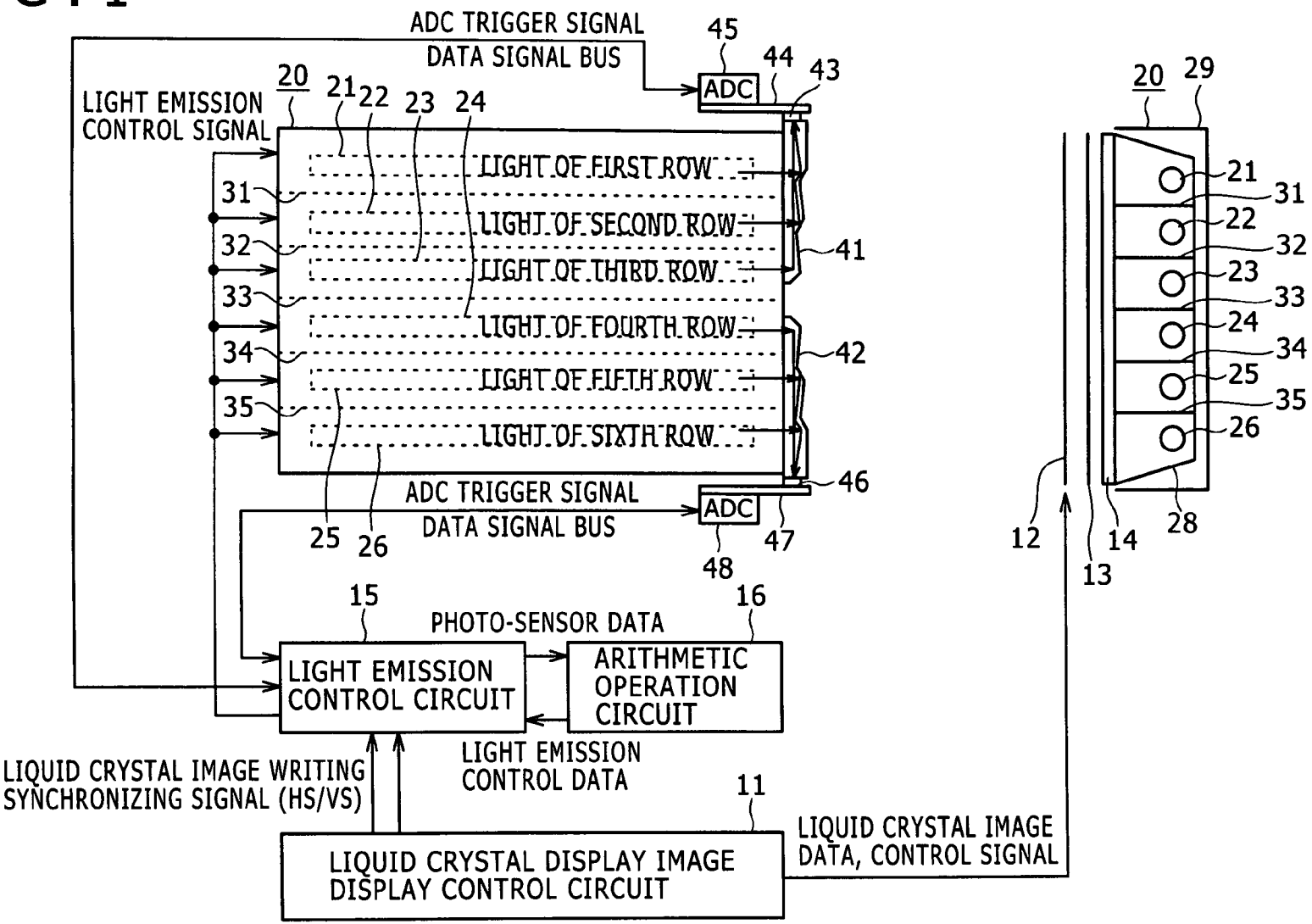
FIG. 1 is a block diagram showing a configuration of a liquid crystal display apparatus to which the present invention is applied.
Figure 3A:
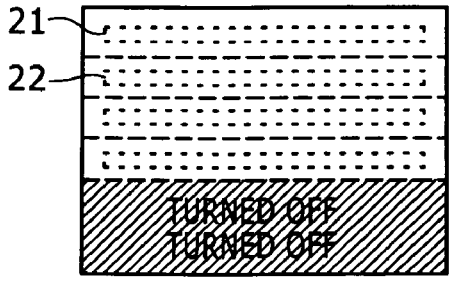
FIGS. 3A to 3F are schematic views illustrating an example of light emission states of the backlight.
Figure 3B:
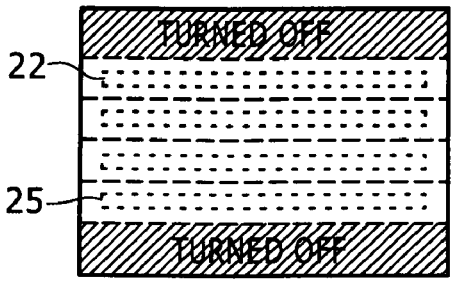
Figure 3C:
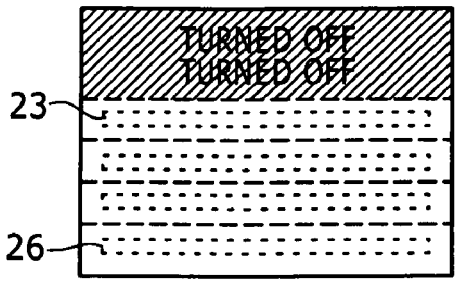
Figure 3D:
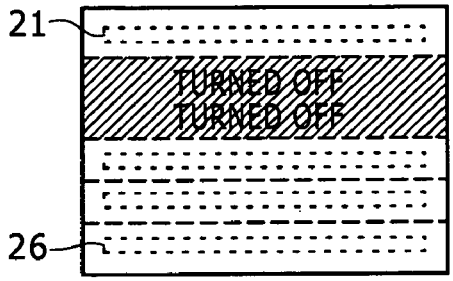
Figure 3E:
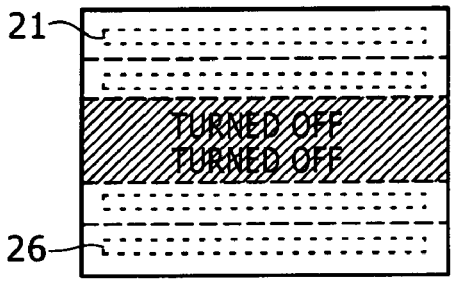
Figure 3F:
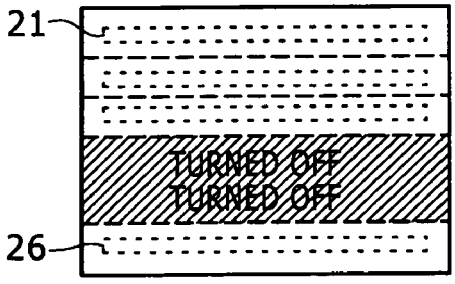

First, a first embodiment of the present invention is described with reference to FIGS. 1 to 4D.

In the present embodiment, the present invention is applied to a liquid crystal display apparatus. First, an example of a general configuration of the liquid crystal display apparatus is described with reference to FIG. 1. It is to be noted that, in FIG. 1, in order to facilitate understanding, a plan view and a vertical sectional view of the liquid crystal display apparatus are shown in a juxtaposed relationship with each other. A video signal or image signal inputted to the liquid crystal display apparatus is supplied to a liquid crystal display image display control circuit 11, which produces a signal for driving a liquid crystal display panel 12 to perform display action based on the video signal. The thus produced displaying driving signal is supplied to the liquid crystal display panel 12, in which a display signal is written into each of pixels disposed on the liquid crystal display panel 12. The writing of the display signal is performed, for example, in a period of one frame in synchronism with a frame period of the video signal supplied thereto.

A backlight 20 is disposed on the back of the liquid crystal display panel 12. In the present embodiment, the backlight 20 includes cold cathode fluorescent lamps 21, 22, 23, 24, 25 and 26 as light sources juxtaposed in a vertical column and each extending in a horizontal direction.

The backlight is configured such that the cold cathode fluorescent lamps 21 to 26 thereof are disposed in a vertical column in a light box 29 which forms the backlight 20. A reflection sheet 28 is disposed on the back side of the cold cathode fluorescent lamps 21 to 26. A diffusion plate 14 is disposed on the front of the light box 29 in which the cold cathode fluorescent lamps 21 to 26 are disposed. The diffusion plate 14 has a size substantially equal to the display area of the liquid crystal display panel 12 and is formed, for example, from an acrylic sheet or plate so that it diffuses light. Further, partition plates 31 to 35 are disposed between adjacent ones of the cold cathode fluorescent lamps 21 to 26 in the light box 29 so that light fluxes from the cold cathode fluorescent lamps 21 to 26 may be introduced to the diffusion plate 14 without mixing with light fluxes from other adjacent lamps.

Lighting or turning on/off of the cold cathode fluorescent lamps 21 to 26 is controlled by light emission control signals supplied individually to the cold cathode fluorescent lamps 21 to 26 from a light emission control circuit 15. A vertical synchronizing signal VS and a horizontal synchronizing signal HS of the video signal are supplied from the liquid crystal display image display control circuit 11 to the light emission control circuit 15 so that the light emission control circuit 15 performs a temporary turning off process successively for the cold cathode fluorescent lamps 21 to 26. The position at which one of the cold cathode fluorescent lamps 21 to 26 is turned off to emit no light and the position of a horizontal line in which writing into pixels of the liquid crystal display panel 12 disposed in front of that one of the cold cathode fluorescent lamps 21 to 26 which is turned off is performed coincide with each other. Thus, a blinking process described hereinabove in the description of the background of the invention is performed.

Further, in the present embodiment, two light guiding members 41 and 42 are disposed at the right end of the light box 29 so that light fluxes entering the light guiding members 41 and 42 from the locations of the cold cathode fluorescent lamps 21 to 26 are introduced to photo-sensors 43 and 46 attached to the light guiding members 41 and 42, respectively. The light guiding members 41 and 42 are made of a transparent material such as, for example, an acrylic resin material.

The light guiding members 41 and 42 are described more particularly. The locations of the fluorescent lamp 21 in the first row, fluorescent lamp 22 in the second row and fluorescent lamp 23 in the third row disposed in order from above are selected such that light fluxes from the fluorescent lamps 21, 22 and 23 are introduced into the first light guiding member 41 at the right end of the light box 29 and then introduced to the photo-sensor 43 on a board 44 provided at an upper end of the backlight 20. The first light guiding member 41 is shaped such that it reflects the light fluxes from the fluorescent lamps 21, 22 and 23 at different angles from one another in order to introduce the light fluxes into the single photo-sensor 43. The light paths in this instance are individually indicated by arrow marks in FIG. 1.

On the other hand, the locations of the fluorescent lamp 24 in the fourth row, fluorescent lamp 25 in the fifth row and fluorescent lamp 26 in the sixth row are selected such that light fluxes from the fluorescent lamps 24, 25 and 26 are introduced into the second light guiding member 42 at the right end of the light box 29 and then introduced into the single photo-sensor 46 on a board 47 provided at a lower end of the backlight 20. Also the second light guiding member 42 is shaped such that it reflects the light fluxes from the fluorescent lamps 24, 25 and 26 at different angles from one another in order to introduce the light fluxes into the single photo-sensor 46. The light paths in this instance are individually indicated by arrow marks in FIG. 1.

The photo-sensors 43 and 46 are configured so as to output a voltage signal corresponding to the level of light incident thereto and each outputs a voltage signal of a level corresponding to the total of luminances of light arriving thereat from the respective three fluorescent lamps. The voltage signals outputted are converted into digital data by analog/digital converters 45 and 48 attached to the boards 44 and 47, respectively, and then sent to the light emission control circuit 15. The light emission control circuit 15 sends a digital conversion trigger pulse to the analog/digital converters 45 and 48, and data sampled at a timing indicated by the trigger pulse are sent to the light emission control circuit 15. An example of the timing for sampling is hereinafter described.

An arithmetic operation circuit 16 is connected to the light emission control circuit 15 such that detection level data of the photo-sensors 43 and 46 supplied to the light emission control circuit 15 are supplied to the arithmetic operation circuit 16. Consequently, the arithmetic operation circuit 16 performs an arithmetic operation process of calculating the luminances of light emitted from the six cold cathode fluorescent lamps 21 to 26 by arithmetic operation using operational expressions set in advance. The operational expressions are hereinafter described.

Now, an example of a corresponding relationship between a writing state of an image into the pixels disposed on the liquid crystal display panel of the display apparatus of the present embodiment and a lighting state of the backlight is described with reference to FIGS. 2A to 2F. In the example illustrated in FIGS. 2A to 2F, writing of an image into the liquid crystal panel is performed in a unit of a horizontal line, and FIGS. 2A to 2F illustrate different writing positions of the image which successively change in order. In each of FIGS. 2A to 2F, the right half illustrates an image writing state into the liquid crystal display panel, and the left half illustrates light emitting and no-light emitting positions of the backlight. The old image in FIGS. 2A to 2F signifies an image of the last frame, and the new image signifies an image of a current frame. As seen in FIGS. 2A to 2F, two fluorescent lamps in the proximity of the position at which an image signal is written into pixels in the current frame, that is, the position of the boundary between an old image and a new image, are turned off to emit not light while the remaining four fluorescent lamps are turned on to emit light.

FIGS. 2A to 2F are investigated more particularly. In FIG. 2A, the position at which an image signal is written is positioned at a lower portion of the screen, and the two lowermost fluorescent lamps 25 and 26 from among the six fluorescent lamps are turned off to emit no light while the remaining four fluorescent lamps are turned on to emit light. If the writing position further moves downwardly from this position, then the lowermost fluorescent lamp 26 and the uppermost fluorescent lamp 21 are turned off and emit no light as seen in FIG. 2B. Then, if the writing position comes the top of the screen, then the two uppermost fluorescent lamps 21 and 22 are turned off and emit no light as seen in FIG. 2C. If the writing position thereafter successively moves downwardly from this position, then the turning off position of two fluorescent lamps successively moves downwardly as seen in FIGS. 2D, 2E and 2F. The transition illustrated in FIGS. 2A to 2F is repeated for every one frame.

Figures 4A, 4B, 4C, 4D:
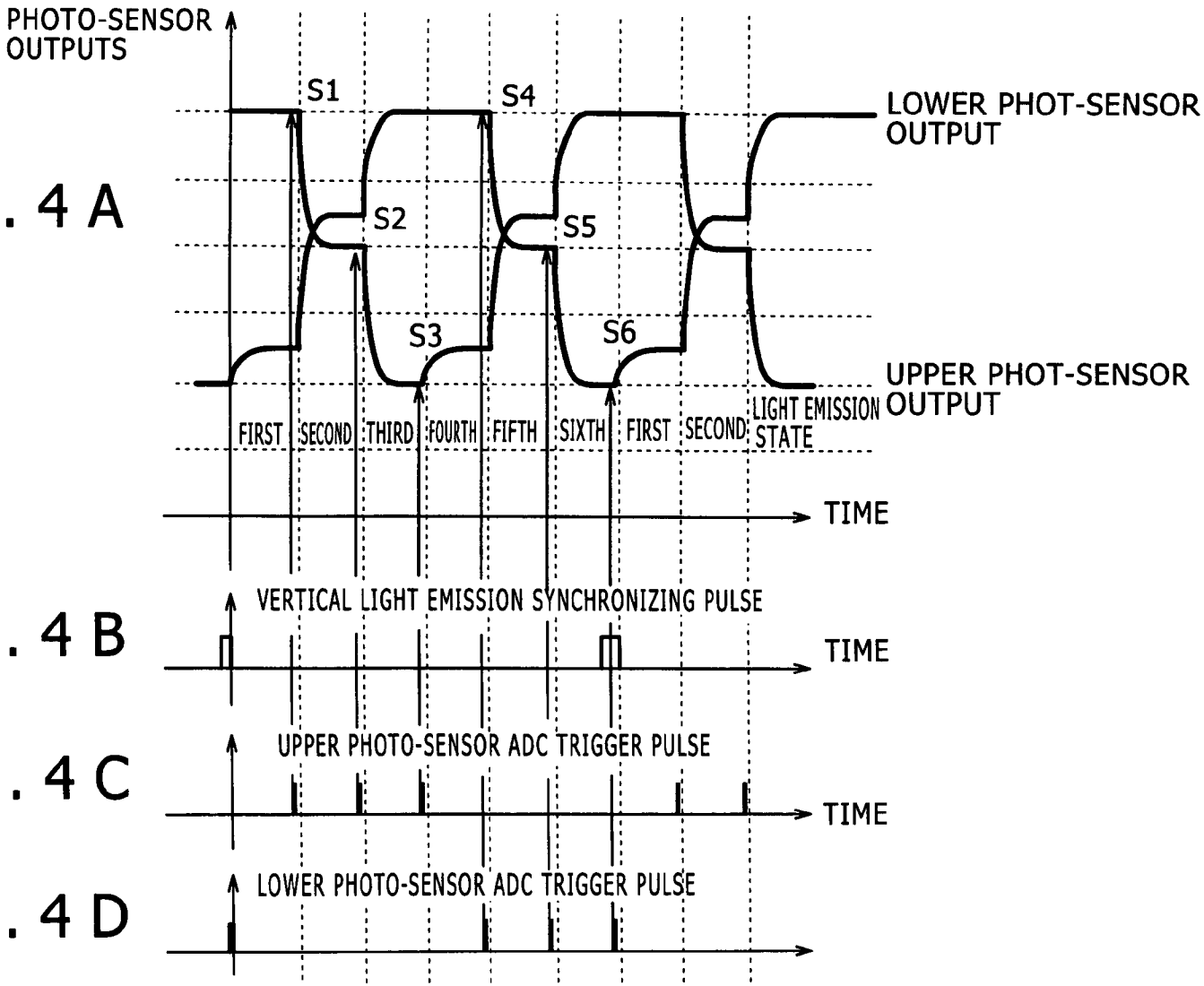
FIGS. 4A to 4D are waveform diagrams illustrating photo-sensor outputs of the liquid crystal display apparatus.

Now, a relationship between lighting states (non-lighting states) in one frame and detection timings of the two photo-sensors 43 and 46 is described with reference to FIGS. 3A to 3F and 4A to 4D. Where first to sixth light emission states wherein the combination of two fluorescent lamps are turned off from among the six fluorescent lamps as seen in FIGS. 3A, 3B, 3C, 3D, 3E and 3F, respectively, are defined, detection is preformed once by each of the photo-sensor 43 and the photo-sensor 46 in each of the light emission states. In particular, where the light emission states are defined as seen in FIGS. 3A to 3F, if two photo-sensor outputs are successively detected within the first to sixth light emission states, then such a state as seen in FIG. 4A is obtained. In FIG. 4A, the upper photo-sensor denotes an output of the photo-sensor 43 while the lower photo-sensor denotes an output of the photo-sensor 46. FIG. 4B illustrates a vertical synchronizing pulse of the display image. As seen in FIG. 4B, a pulse appears immediately prior to the first light emission state.

As seen in FIG. 4A, the outputs of the two photo-sensors 43 and 46 repeat a variation in response to the variation of the position at which fluorescent lamps are turned off. FIG. 4C indicates a trigger pulse to be used for sampling of the output of the photo-sensor 43 while FIG. 4D illustrates a trigger pulse to be used for sampling of the output of the photo-sensor 46. As seen from FIGS. 4A to 4D, the output of the photo-sensor 43 is fetched in the first to third states, and the output of the photo-sensor 46 is fetched in the fourth to sixth states. In FIG. 4A, the sensor outputs fetched in the first to sixth light emission states are represented as signals S1 to S6, respectively.

Where the detection data S1 of the upper photo-sensor 43 in the first light emission state, the detection data S2 of the upper photo-sensor 43 in the second light emission state, the detection data S3 of the upper photo-sensor 43 in the third light emission state, the detection data S4 of the lower photo-sensor 46 in the fourth light emission state, the detection data S5 of the lower photo-sensor 46 in the fifth light emission state and the detection data S6 of the lower photo-sensor 46 in the sixth light emission state are defined in this manner, if the emitted light amounts of the cold cathode fluorescent lamps 21, 22, 23, 24, 25 and 26 are defined as L1, L2, L3, L4, L5 and L6 in order, respectively, then the relational equations between the photo-sensor outputs and the light amounts of the fluorescent lamps are such as given below:

[Equation 1]

$$S1 = L1 + L2 + L3$$
$$S2 = L2 + L3$$
$$S3 = L3$$

$$\begin{bmatrix} S1 \\ S2 \\ S3 \end{bmatrix} = \begin{bmatrix} 1 & 1 & 1 \\ 0 & 1 & 1 \\ 0 & 0 & 1 \end{bmatrix} \begin{bmatrix} L1 \\ L2 \\ L3 \end{bmatrix}$$

$$S4 = L4 + L5 + L6$$
$$S5 = L5 + L6$$
$$S6 = L6$$

$$\begin{bmatrix} S4 \\ S5 \\ S6 \end{bmatrix} = \begin{bmatrix} 1 & 1 & 1 \\ 0 & 1 & 1 \\ 0 & 0 & 1 \end{bmatrix} \begin{bmatrix} L4 \\ L5 \\ L6 \end{bmatrix}$$

By using the relational equations to solve the following matrices, the emitted light amounts L1, L2, L3, L4, L5 and L6 of the six cold cathode fluorescent lamps 21, 22, 23, 24, 25 and 26 are determined:

$$\begin{bmatrix} L1 \\ L2 \\ L3 \end{bmatrix} = \begin{bmatrix} 1 & -1 & 0 \\ 0 & 1 & -1 \\ 0 & 0 & 1 \end{bmatrix} \begin{bmatrix} S1 \\ S2 \\ S3 \end{bmatrix} \quad \text{[Equation 2]}$$

$$\begin{bmatrix} L4 \\ L5 \\ L6 \end{bmatrix} = \begin{bmatrix} 1 & -1 & 0 \\ 0 & 1 & -1 \\ 0 & 0 & 1 \end{bmatrix} \begin{bmatrix} S4 \\ S5 \\ S6 \end{bmatrix}$$

This arithmetic operation process is executed by the arithmetic operation circuit 16 shown in FIG. 1. Data of individual emitted light luminances of the six fluorescent lamps 21 to 26 obtained by the arithmetic operation circuit 16 are sent to the light emission control circuit 15. The light emission control circuit 15 performs a process of correcting the emitted light luminances of the fluorescent lamps 21 to 26 based on the data of the emitted light luminances. The correction process for each emitted light luminance is performed, for example, by control of the voltage to be applied to the corresponding fluorescent lamp. By performing the emitted light luminance correction based on the data detected by the two photo-sensors 43 and 46 in this manner, the emitted light luminances of the six fluorescent lamps 21 to 26 can always be corrected to a uniform level. For example, even if some variation of the environment of use or a secular change occurs, an uniform emitted light condition can always be assured, and appearance of unevenness in brightness of the image displayed through illumination by the backlight can be prevented.

In this instance, since the liquid crystal display apparatus of the present embodiment includes only two light guiding members 41 and 42 and two photo-sensors 43 and 46, it has a configuration simpler than that in an alternative case wherein a photo-sensor is provided for each of six light sources. Consequently, the cost demanded for production of a backlight can be reduced.

Now, a liquid crystal display apparatus according to a second embodiment of the present invention is described with reference to FIG. 5. The liquid crystal display apparatus of the present embodiment is a modification to and has a generally similar configuration to that of the liquid crystal display apparatus of the first embodiment described hereinabove with reference to FIGS. 1 to 4D. Therefore, in the following description, only differences of the liquid crystal display apparatus of the present embodiment from those of the first embodiment are described. The liquid crystal display apparatus of the present embodiment is generally configured such that it includes a single photo-sensor such that the luminance of all light sources is detected by the single photo-sensor and the luminances of the light sources are determined from detection outputs at different timings from the single photo-sensor.

Figure 5:
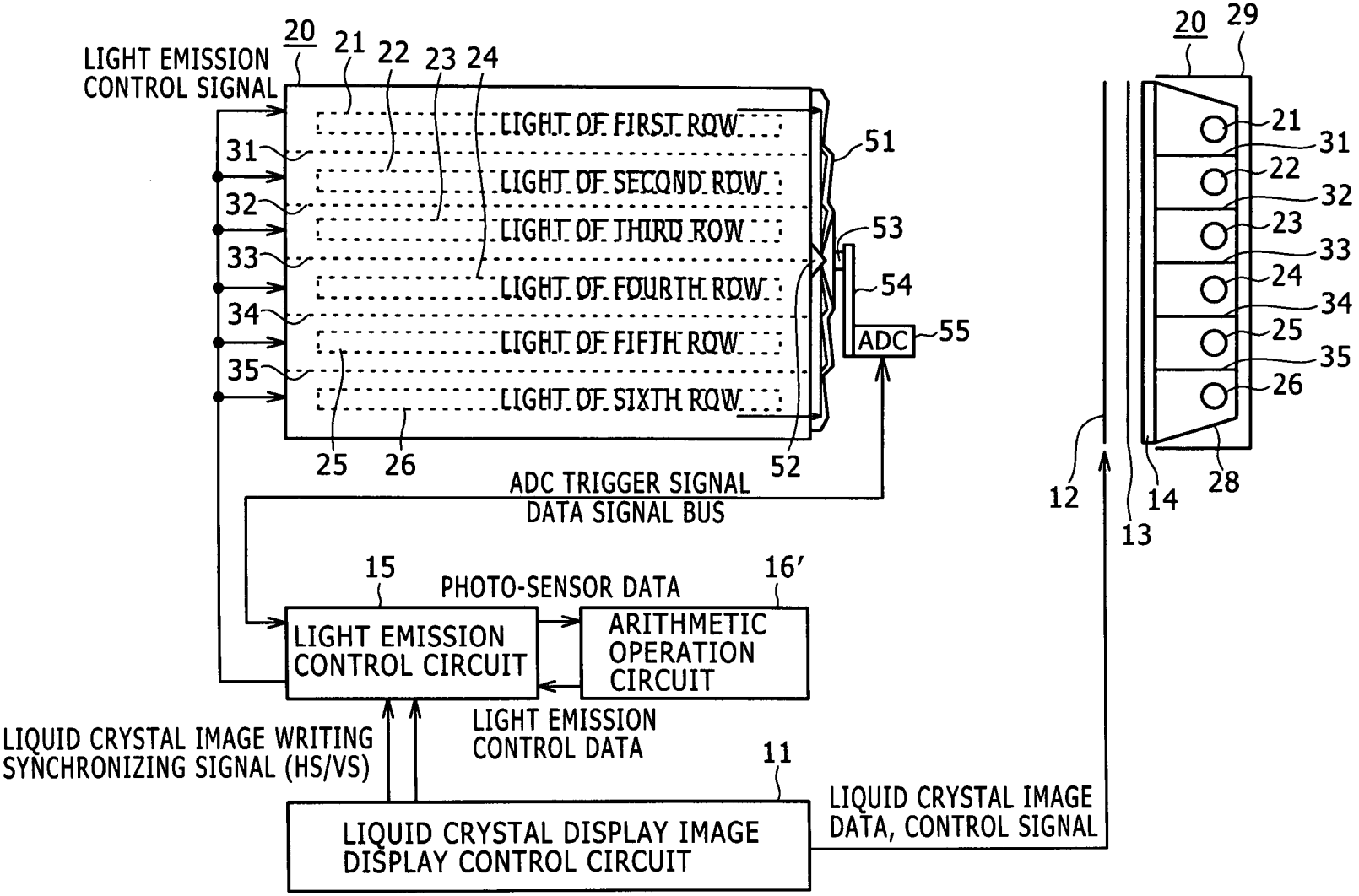
FIGS. 5 to 7 are block diagrams showing a configuration of different liquid crystal display apparatus to which the present invention is applied.

In particular, referring to FIG. 5, a light guiding member 51 for guiding light from the six cold cathode fluorescent lamps 21 to 26 to a single photo-sensor 53 is disposed at the right end of the backlight 20 in which the cold cathode fluorescent lamps 21 to 26 are disposed such that the photo-sensor 53 detects the total of outputs of the cold cathode fluorescent lamps 21 to 26. The light guiding member 51 may be made of, for example, n acrylic resin material. The liquid crystal display apparatus further includes a reflecting mirror 52 disposed for reflecting light directed toward the center by the light guiding member 51 so as to be inputted to the photo-sensor 53. The photo-sensor 53 is attached to a board 54 and fetches a signal as digital data from an analog/digital converter 55 attached to the board 54. The digital data are sent to the light emission control circuit 15.

The emitted light amount data sent from the photo-sensor 53 are sent to an arithmetic operation circuit 16', and the emitted light amounts of the cold cathode fluorescent lamps 21 to 26 are calculated from the received emitted light amount data by arithmetic operation of the arithmetic operation circuit 16'. It is to be noted that, since the liquid crystal display apparatus shown in FIG. 5 includes a single photo-sensor, it is necessary to change the light emission pattern and the operational expressions of the lamps from those of the liquid crystal display apparatus shown in FIGS. 1 to 4D. Where the configuration shown in FIG. 5 is employed, the number of photo-sensors can be reduced to one, and consequently, a more simplified configuration can be achieved.

Figure 6:
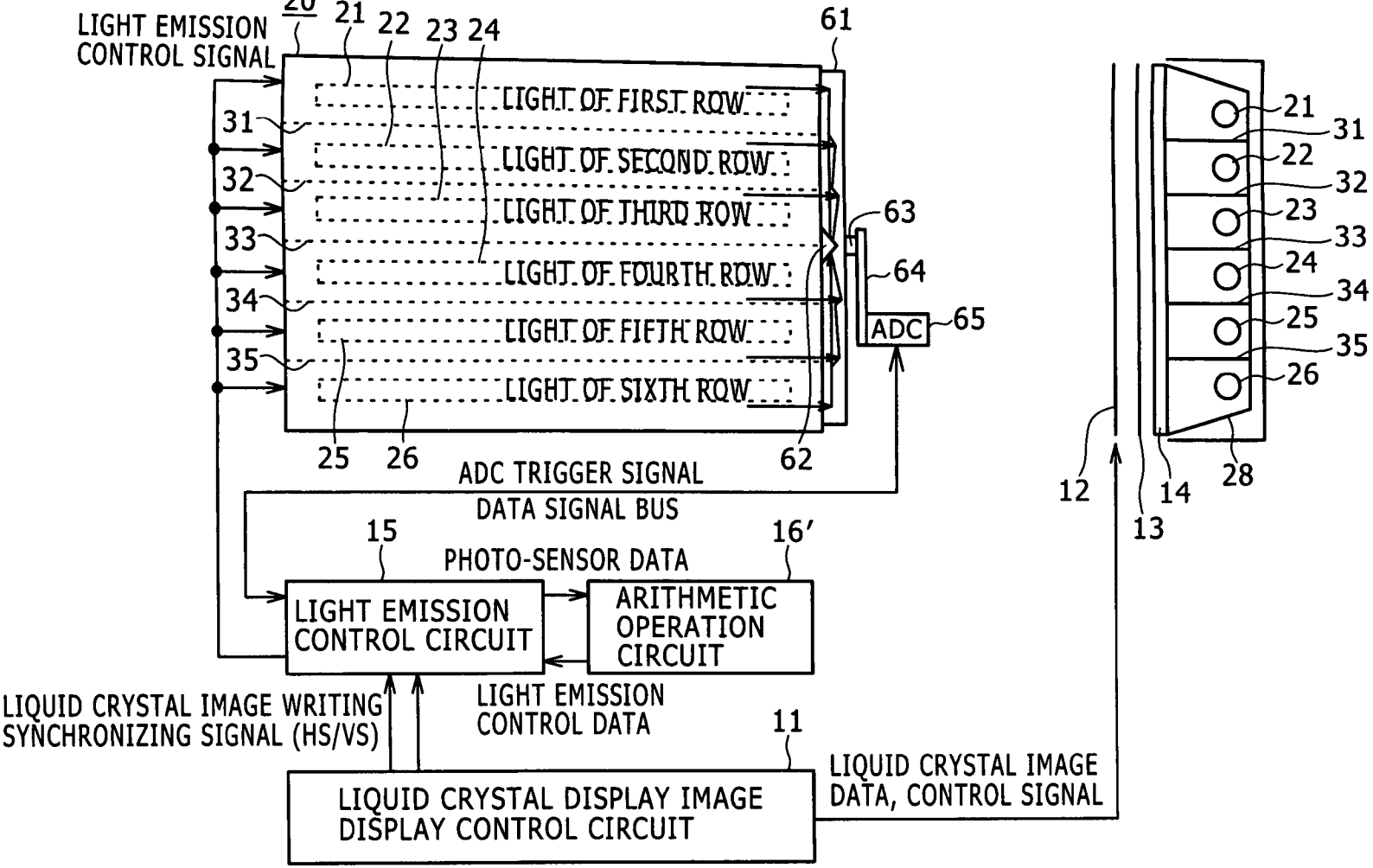

Now, a liquid crystal display apparatus according to a third embodiment of the present invention is described with reference to FIG. 6. The liquid crystal display apparatus of the present embodiment is a modification to and has a generally similar configuration to that of the liquid crystal display apparatus of the second embodiment described hereinabove with reference to FIG. 5. Therefore, in the following description, only differences of the liquid crystal display apparatus of the present embodiment from those of the second embodiment are described. Referring to FIG. 6, the liquid crystal display apparatus according to the third embodiment shown is generally configured such that the light guiding member has a more simplified configuration. In particular, the light guiding member in the first and second embodiments shown in FIGS. 1 and 4 is configured such that it is made of an acrylic resin material or the like and guides light. In contrast, the light guiding member in the present embodiment is configured such that it has a form of a reflection sheet disposed in the light box which is a component of the backlight and inputs light to one or two photo-sensors.

In particular, a light guiding light guiding hollow member 61 is disposed at the right end of the light box 29, and a reflection element is disposed on an inner wall of the light guiding hollow member 61. Further, a reflecting mirror 62 is disposed at a central portion of the reflecting member so that light reflected by the reflecting mirror 62 is introduced into a photo-sensor 63. The photo-sensor 63 is attached to a board 64, and an output of the photo-sensor 63 is converted into digital data by an analog/digital converter 65 and supplied to the light emission control circuit 15 side.

Where the liquid crystal display apparatus is configured in such a manner as described above, the necessity for a light guiding member of an acrylic resin material or the like is eliminated, and a simpler light guiding configuration can be achieved.

Now, a liquid crystal display apparatus according to a fourth embodiment of the present invention is described with reference to FIG. 7. The liquid crystal display apparatus of the present embodiment is a modification to and has a generally similar configuration to that of the liquid crystal display apparatus of the first embodiment described hereinabove with reference to FIGS. 1 to 4D. Therefore, in the following description, only differences of the liquid crystal display apparatus of the present embodiment from those of the first embodiment are described. In particular, the liquid crystal display apparatus of the present embodiment uses a light emitting diode for the light sources. In particular, a backlight 70 disposed on the back of the liquid crystal display panel 12 includes red light emitting diodes 71R to 76R, green light emitting diodes 71G to 76G and blue light emitting diodes 71B to 76B disposed in order in individual rows. A light box 79 is configured such that the inside of a reflecting sheet 78 is partitioned into six portions in the vertical direction by partition plates 31 to 35 similarly as in the light box 29 shown in FIG. 1. In each of the partitions which are rows as seen in FIG. 7, red light emitting diodes, green light emitting diodes and blue light emitting diodes are disposed in order.

Figure 7:
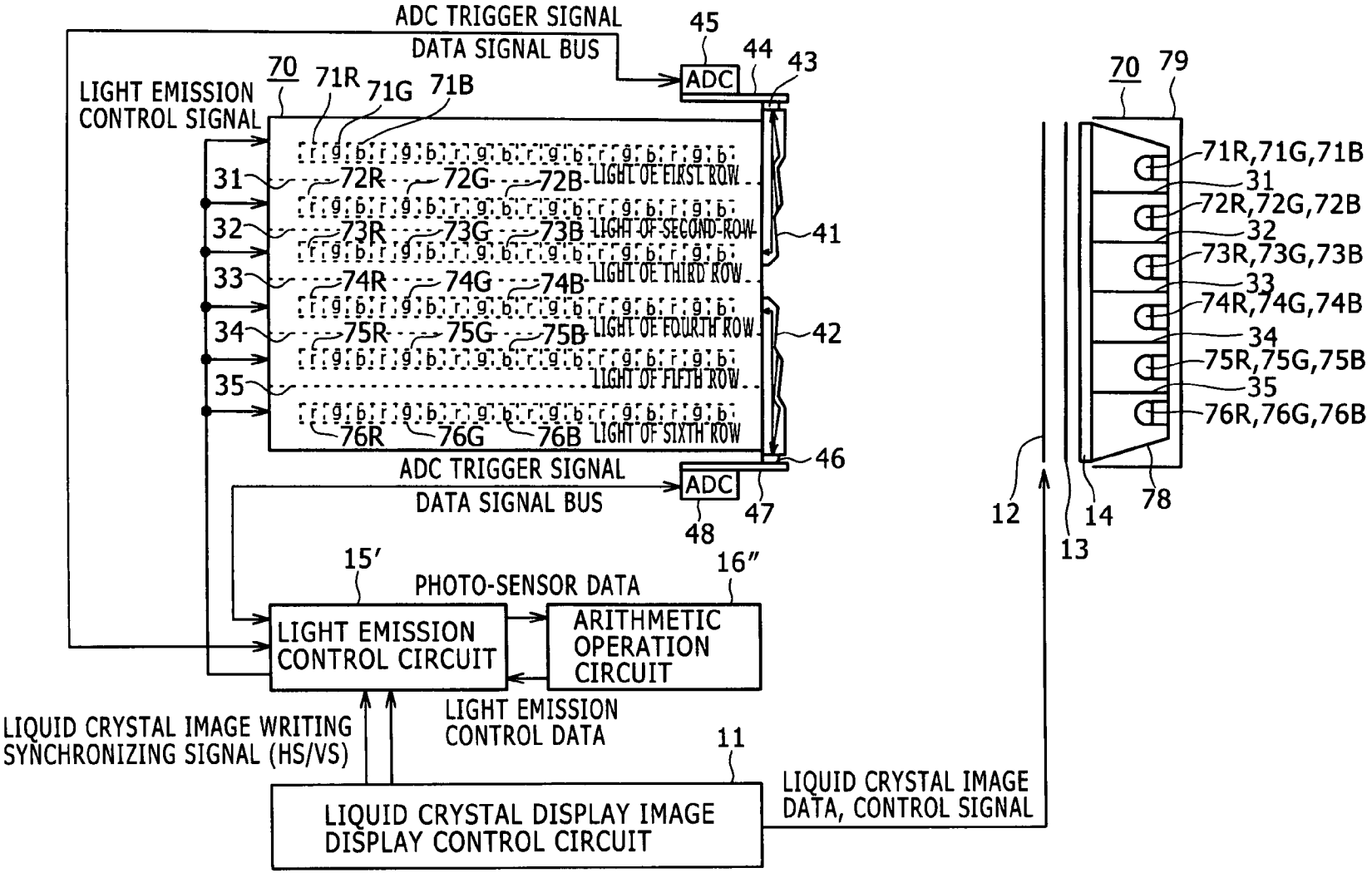
Figure 8A:
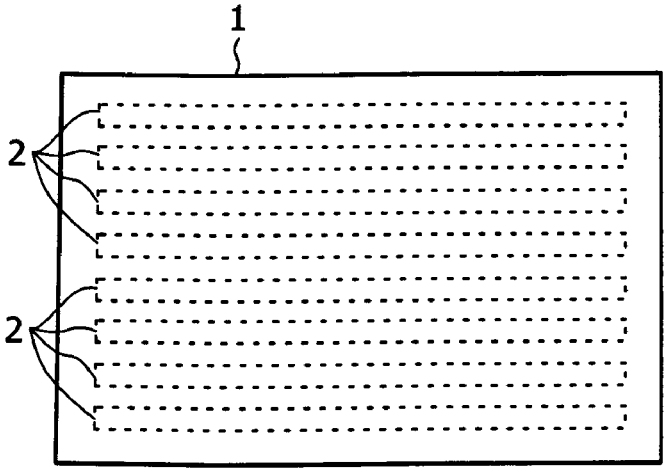
FIGS. 8A and 8B are schematic views showing a configuration of an example of a backlight in the past.
Figure 8B:
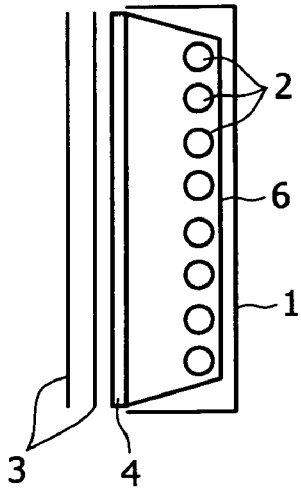
Figure 9A:
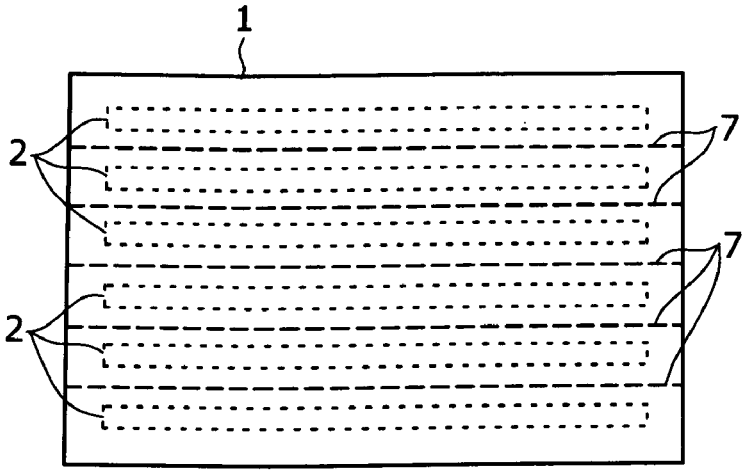
FIGS. 9A and 9B are schematic views showing a configuration of another example of a backlight in the past.
Figure 9B:
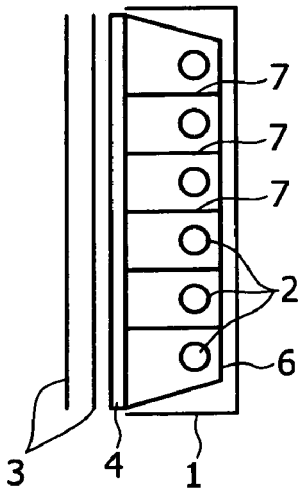
Figure 10:
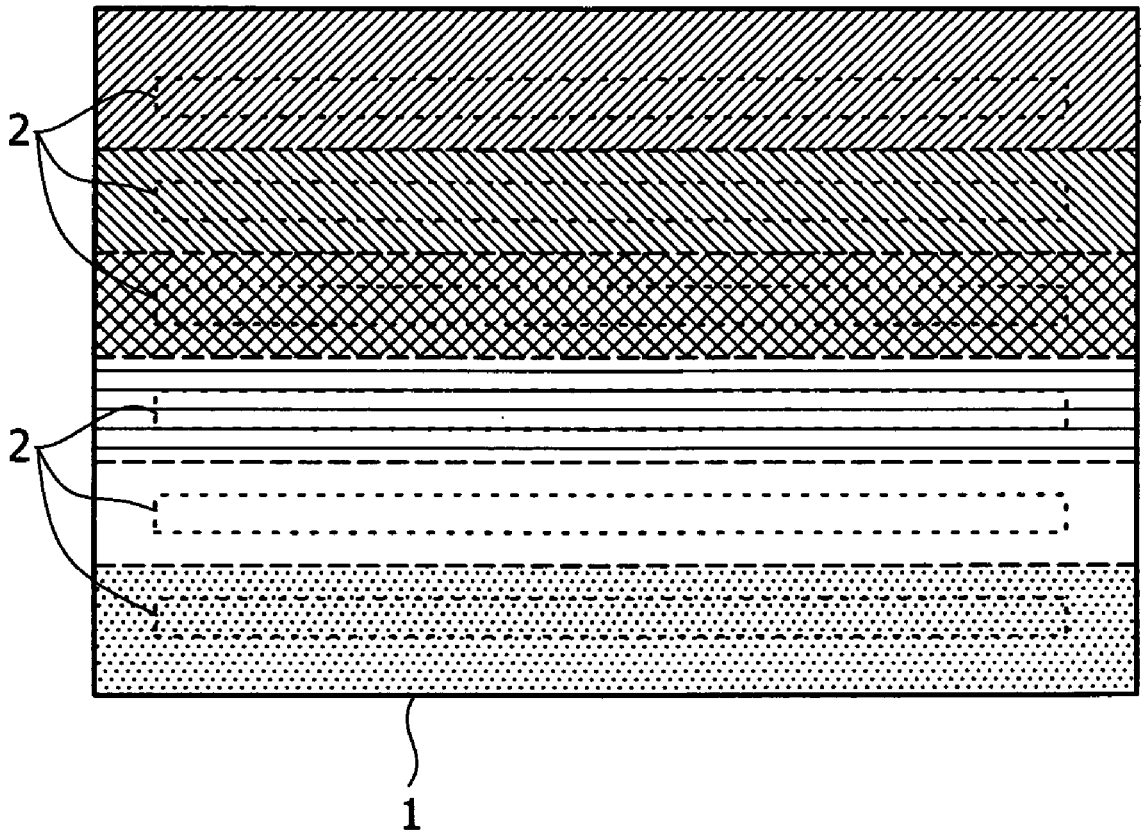
FIG. 10 is a schematic view illustrating display unevenness which appears with the backlight of FIGS. 9A and 9B.

In the arrangement shown in FIG. 7, a demanded number of red light emitting diodes 71R, green light emitting diodes 71G and blue light emitting diodes 71B are disposed in a row in a horizontal direction in the top one of the sections in the light box 79, that is, in the first row. In the second row which is the next partition, a demanded number of red light emitting diodes 72R, green light emitting diodes 72G and blue light emitting diodes 72B are disposed in a row. In the third row, a demanded number of red light emitting diodes 73R, green light emitting diodes 73G and blue light emitting diodes 73B are disposed in a row. In the fourth row, a demanded number of red light emitting diodes 74R, green light emitting diodes 74G and blue light emitting diodes 74B are disposed in a row. In the fifth row, a demanded number of red light emitting diodes 75R, green light emitting diodes 75G and blue light emitting diodes 75B are disposed in a row. In the sixth row, a demanded number of red light emitting diodes 76R, green light emitting diodes 76G and blue light emitting diodes 76B are disposed in a row.

Two light guiding members 41 and 42 are disposed at the right end of the light box 79 such that light introduced into the light guiding members 41 and 42 from the locations of the light emitting diodes is introduced into the photo-sensors 43 and 46 attached to the light guiding members 41 and 42, respectively. The light guiding members 41 and 42 are made of a transparent material such as, for example, an acrylic resin material.

The light guiding members 41 and 42 are described more particularly. The light emitting diodes 71R, 71G and 71B in the first row, light emitting diodes 72R, 72G and 72B in the second row and light emitting diodes 73R, 73G and 73B in the third row in order from above are located such that light therefrom is introduced to the first light guiding member 41 at the right end of the light box 79 so that it is introduced into the photo-sensor 43 on the board 44 attached to an upper end of the backlight 70. The first light guiding member 41 is shaped such that, in order to introduce light fluxes from the light emitting diodes in the first, second and third rows to the single photo-sensor 43, it reflects the light fluxes at different angles from one another.

Meanwhile, the light emitting diodes 74R, 74G and 74B in the fourth row, light emitting diodes 75R, 75G and 75B in the fifth row and light emitting diodes 76R, 76G and 76B in the sixth row are located such that light therefrom is introduced to the second light guiding member 42 at the right end of the light box 79 so that it is introduced into the photo-sensor 46 on the board 47 attached to a lower end of the backlight 70. Also the second light guiding member 42 is shaped such that, in order to introduce light fluxes from the light emitting diodes in the fourth, fifth and sixth rows to the single photo-sensor 46, it reflects the light fluxes at different angles from one another.

The photo-sensors 43 and 46 are configured so as to output a voltage signal corresponding to the level of light incident thereto. In particular, each of the photo-sensors 43 and 46 outputs a voltage signal of a level corresponding to the total of luminances of light fluxes arriving thereat from the light emitting diodes of the corresponding three rows. The voltage signal outputted from the photo-sensor 43 or 46 is converted into digital data by an analog/digital converter 45 or 48 attached to the board 44 or 47 and then sent to a light emission control circuit 15'. The light emission control circuit 15' sends a digital conversion trigger pulse to the analog/digital converters 45 and 48. Consequently, data sampled at a timing indicated by the trigger pulse are sent to the light emission control circuit 15'.

An arithmetic operation circuit 16" is connected to the light emission control circuit 15' such that detection level data of the photo-sensors 43 and 46 supplied to the light emission control circuit 15' are supplied to the arithmetic operation circuit 16". The arithmetic operation circuit 16" thus performs an arithmetic operation process of calculating emitted light luminances of the light emitting diodes in the six rows by arithmetic operation in which operational expressions set in advance are used. To the operational expressions, those given hereinabove in the description of the first embodiment can be applied.

Since the liquid crystal display apparatus of the present embodiment is configured in such a manner as described above, similar emitted light luminance control of light sources can be applied also where a light emitting diode is used for the light sources, and similar good image display can be anticipated. It is to be noted that, while the numbers of red light emitting diodes, green light emitting diodes and blue light emitting diodes in the arrangement of FIG. 7 are equal to one another, different numbers of red, green and blue light emitting diodes may be disposed in response to emitted light luminance characteristics of the light emitting diodes so that white backlight light may be obtained.

It is to be noted that, in the liquid crystal display apparatus of FIG. 7, each of the photo-sensors 43 and 46 is formed as a sensor for detecting the luminance, and a process of correcting the emitted light luminance of the light source is performed based on an output of the sensor. However, each of the photo-sensors 43 and 46 may otherwise detect the chromaticity. Where the chromaticity is detected by the photo-sensors 43 and 46 in this manner, the emitted light amounts of the light emitting diodes of the colors are controlled in response to detection values of the chromaticity to perform correction of the chromaticity, that is, to correct the offset from the white. Where correction of the color is performed in this manner, better backlight light is obtained. It is to be noted that the control of the emitted light amount of the light emitting diodes may be, for example, control of the amount of current to be supplied to the light emitting diodes or control of the period of time within which current is supplied to the light emitting diodes.

Also where a cathode ray fluorescent lamp is used as in the first to third embodiments described hereinabove, the chromaticity of the fluorescent lamps may be decided such that the emitted light colors of the light sources are corrected individually based on the decision.

Further, while, in the embodiments described hereinabove, a cathode ray fluorescent lamp or a light emitting diode is used as a light source, some other light source such as a hot cathode fluorescent lamp may used such that the luminance or the chromaticity of the light source is corrected. Also where a light emitting diode is used, for example, a light emitting diode which emits white light may be used. Further, the present invention can be applied also where a plurality of different types of light sources such as a cold cathode fluorescent lamp and a light emitting diode are used in combination.

Further, in the embodiments described above, a light source is divided into six light sources in the vertical direction. However, the light source may be divided also into a plurality of light sources in the horizontal direction and hence into a matrix. In this instance, the luminance of the light sources is detected and corrected using a limited number of photo-sensors.

Further, in the embodiments described hereinabove, the present invention is applied to a backlight configured such that a partitioning member or partition plate is disposed between adjacent ones of light sources. However, the present invention can be applied also to another backlight apparatus which includes no partitioning member and allows light fluxes from adjacent light sources to mix with each other. In this instance, however, it is necessary to decide the luminance or the like of each light source taking also the influence of light from an adjacent light source into consideration.

It should be understood by those skilled in the art that various modifications, combinations, sub-combinations and alterations may occur depending on design requirements and other factors insofar as they are within the scope of the appended claims or the equivalents thereof.

The invention claimed is:

1. A backlight for illuminating the back of a display section, comprising:

a plurality of light sources disposed in positions corresponding to a display area of the display section, each of the light sources extending lengthwise from a first end to a second end opposing the first end;

a diffusion member configured to transmit light from the light sources to the display section;

a photo-sensor;

a light guiding member configured to introduce the light from the light sources to the photo-sensor for detection; and an arithmetic operation processing section configured to calculate luminance or chromaticity of each of the light sources from the luminance or chromaticity detected by the photo-sensor, in which the light sources are grouped into a first group and a second group, in which the first group includes a first plurality of light sources and the second group includes a second plurality of light sources, the photo-sensor includes a pair of photo-sensor elements, and the light guiding member includes a first light guiding element and a second light guiding element, in which the first light guiding element is disposed at the first ends of light sources of the first plurality of light sources so first light fluxes, respectively, from the first ends of the first plurality of light sources enter the first light guiding element and is shaped to reflect the first light fluxes entering the first light guiding element at different angles from one another so as to introduce the reflected first light fluxes to only one photo-sensor element of the photo-sensor elements for detection, and in which the second light guiding element is disposed at the first ends of light sources of the second plurality of light sources so second light fluxes, respectively, from the first ends of the second plurality of light sources enter the second light guiding element and is shaped to reflect the second light fluxes entering the second light guiding element at different angles from one another so as to introduce the reflected second light fluxes to only another photo-sensor element of the photo-sensor elements for detection, such that during operation the reflected first light fluxes from the first plurality of light sources entering the first light guiding element are introduced to the one photo-sensor element of the photo-sensor elements for detection and none of the reflected second light fluxes from the second plurality of light sources entering the second light guiding element are introduced to the one photo-sensor element of the photo-sensor elements, and the reflected second light fluxes from the second plurality of light sources entering the second light guiding element are introduced to the another photo-sensor element of the photo-sensor elements for detection and none of the reflected first light fluxes from the first plurality of light sources entering the first light guiding element are introduced to the another photo-sensor element of the photo-sensor elements for detection, wherein the one and the another photo-sensor elements are attached to the light guiding member to detect, respectively, only the reflected first light fluxes and the reflected second light fluxes.

2. The backlight according to claim 1, wherein the arithmetic operation processing section calculates the luminance or chromaticity of each of the light sources from the luminance or chromaticity detected by the pair of photo-sensor elements.

3. The backlight according to claim 1, wherein the luminance or chromaticity of each of the light sources is corrected based on the luminance or chromaticity of individual ones of the light sources calculated based on a result of the arithmetic operation process by the arithmetic operation processing section.

4. The backlight according to claim 1, wherein the arithmetic operation processing section causes the light sources to blink individually in synchronization with a frame period of an image signal to be displayed on the display section, and decides from which one of the light sources light is inputted to the photo-sensor through the blinking control to calculate the luminance or chromaticity of each of the light sources.

5. The backlight according to claim 1, wherein each of the light sources is a fluorescent lamp.

6. The backlight according to claim 1, wherein each of the light sources is a light emitting diode.

7. A display apparatus, comprising:

a display section configured to display an image corresponding to an input image signal; and a backlight for illuminating the back of the display section, the backlight including a plurality of light sources disposed in positions corresponding to a display area of the display section, each of the light sources extending lengthwise from a first end to a second end opposing the first end;

a diffusion member configured to transmit light from the light sources to the display section;

a photo-sensor;

a light guiding member configured to introduce the light from the light sources to the photo-sensor for detection; and an arithmetic operation processing section configured to calculate luminance or chromaticity of each of the light sources from the luminance or chromaticity detected by the photo-sensor, in which the light sources are grouped into a first group and a second group, in which the first group includes a first plurality of light sources and the second group includes a second plurality of light sources, the photo-sensor includes a pair of photo-sensor elements, and the light guiding member includes a first light guiding element and a second light guiding element, in which the first light guiding element is disposed at the first ends of light sources of the first plurality of light sources so first light fluxes, respectively, from the first ends of the first plurality of light sources enter the first light guiding element and is shaped to reflect the first light fluxes entering the first light guiding element at different angles from one another so as to introduce the reflected first light fluxes to only one photo-sensor element of the photo-sensor elements for detection, and in which the second light guiding element is disposed at the first ends of light sources of the second plurality of light sources so second light fluxes, respectively, from the first ends of the second plurality of light sources enter the second light guiding element and is shaped to reflect the second light fluxes from the second plurality of light sources entering the second light guiding element at different angles from one another so as to introduce the reflected second light fluxes from the second plurality of light sources to only another photo-sensor element of the photo-sensor elements for detection, such that during operation the reflected first light fluxes from the first plurality of light sources entering the first light guiding element are introduced to the one photo-sensor element of the photo-sensor elements for detection and none of the reflected second light fluxes from the second plurality of light sources entering the second light guiding element are introduced to the one photo-sensor element of the photo-sensor elements, and the second light fluxes from the second plurality of light sources entering the second light guiding element are introduced to the another photo-sensor element of the photo-sensor elements for detection and none of the first light fluxes from the first plurality of light sources entering the first light guiding element are introduced to the another photo-sensor element of the photo-sensor elements for detection, wherein the one and the another photo-sensor elements are attached to the light guiding member to detect, respectively, only the reflected first light fluxes and the reflected second light fluxes.

8. The display apparatus according to claim 7, wherein the arithmetic operation processing section calculates the luminance or chromaticity of each of the light sources from the luminance or chromaticity detected by the pair of photo-sensor elements.

9. The display apparatus according to claim 7, wherein the arithmetic operation processing section causes the light sources to blink individually in synchronization with a frame period of the input image signal, and decides from which one of the light sources light is inputted to the photo-sensor through the blinking control to calculate the luminance or chromaticity of each of the light sources.

10. The display apparatus according to claim 7, wherein the luminance or chromaticity of each of the light sources is corrected based on the luminance or chromaticity of individual ones of the light sources calculated based on a result of the arithmetic operation process by the arithmetic operation processing section.

11. The display apparatus according to claim 7, wherein each of the light sources is a fluorescent lamp.

12. The display apparatus according to claim 7, wherein each of the light sources is a light emitting diode.

13. A light source controlling method for controlling luminance or chromaticity of a plurality of light sources which illuminate the back of a display section, the method comprising:

providing a number of light sources disposed in positions corresponding to a display area of the display section, each of the light sources extending lengthwise from a first end to a second end opposing the first end;

providing a number of photo-sensors which is smaller than the number of light sources;

providing a light guiding member configured to introduce the light from the light sources to the number of photo-sensors for detection;

detecting the luminance or chromaticity of light from the number of light sources using the number of photo-sensors;

calculating the luminance or chromaticity of each of the light sources from the luminance or chromaticity detected by the number of photo-sensors; and controlling the light sources individually based on the calculated luminance or chromaticity of each of the light sources, in which the number of light sources are grouped into a first group and a second group, in which the first group includes a first plurality of light sources and the second group includes a second plurality of light sources, the number of photo-sensors includes a pair of photo-sensor elements, and the light guiding member includes a first light guiding element and a second light guiding element, in which the first light guiding element is disposed at the first ends of light sources of the first plurality of light sources so first light fluxes, respectively, from the first ends of the first plurality of light sources enter the first light guiding element and is shaped to reflect the first light fluxes from the first plurality of light sources entering the first light guiding element at different angles from one another so as to introduce the reflected first light fluxes to only one photo-sensor element of the photo-sensor elements for detection, and in which the second light guiding element is disposed at the first ends of light sources of the second plurality of light sources so second light fluxes, respectively, from the first ends of the second plurality of light sources enter the second light guiding element and is shaped to reflect the second light fluxes from the second plurality of light sources entering the second light guiding element at different angles from one another so as to introduce the reflected second light fluxes to only another photo-sensor element of the photo-sensor elements for detection, such that during operation the reflected first light fluxes from the first plurality of light sources entering the first light guiding element are introduced to the one photo-sensor element of the photo-sensor elements for detection and none of the reflected second light fluxes from the second plurality of light sources entering the second light guiding element are introduced to the one photo-sensor element of the photo-sensor elements, and the reflected second light fluxes from the second plurality of light sources entering the second light guiding element are introduced to the another photo-sensor element of the photo-sensor elements for detection and none of the reflected first light fluxes from the first plurality of light sources entering the first light guiding element are introduced to the another photo-sensor element of the photo-sensor elements for detection, wherein the one and the another photo-sensor elements are attached to the light guiding member to detect, respectively, only the reflected first light fluxes and the reflected second light fluxes.

* * * * *